US006558222B1

(12) United States Patent
Maddock

(10) Patent No.: US 6,558,222 B1
(45) Date of Patent: May 6, 2003

(54) PANELLING AND SUPPORTS FOR INTERCONNECTED TOY BLOCKS

(76) Inventor: Paul Thomas Maddock, c/o Vecta Blocks Inc. 1515 Pitfield Street, St. Laurent, Quebec (CA), H4S 1G3

( * ) Notice: Subject to any disclaimer, the term of this patent is extended or adjusted under 35 U.S.C. 154(b) by 0 days.

(21) Appl. No.: 09/551,605

(22) Filed: Apr. 17, 2000

Related U.S. Application Data

(63) Continuation-in-part of application No. 09/149,477, filed on Sep. 8, 1998, now Pat. No. 6,059,631, which is a continuation-in-part of application No. PCT/CA97/00138, filed on Feb. 28, 1997.

(60) Provisional application No. 60/170,780, filed on Dec. 15, 1999.

(51) Int. Cl.[7] ..... A63H 33/12

(52) U.S. Cl. ..... 446/105; 446/120; 446/124

(58) Field of Search ..... 446/105, 111, 446/112, 116, 115, 119, 120, 127, 128, 124

(56) References Cited

U.S. PATENT DOCUMENTS

| | | | | |
|---|---|---|---|---|
| 1,281,856 | A | 10/1918 | Shaw | |
| 1,294,448 | A | 2/1919 | Greenstreet | |
| 1,883,214 | A | 10/1932 | Wilson et al. | |
| 1,898,297 | A | 2/1933 | Fox | |
| 2,028,229 | A | 1/1936 | Luhn | |
| 2,407,927 | A * | 9/1946 | Hayden | 446/105 |
| 2,472,363 | A | 6/1949 | Blackington | |
| 2,619,829 | A | 12/1952 | Tatum | |
| 2,633,662 | A | 4/1953 | Nelson | |
| 2,907,137 | A | 10/1959 | Ehrmann | |
| 3,005,282 | A | 10/1961 | Christiansen | |
| 3,032,919 | A | 5/1962 | Amsler | |
| 3,456,413 | A | 7/1969 | Fischer | |
| 3,558,138 | A | 1/1971 | Lemelson | |
| 3,624,954 | A | 12/1971 | Van Deveken | |
| 3,626,632 | A | 12/1971 | Bullock, Jr. | |
| 3,657,838 | A | 4/1972 | Hanning et al. | |
| 3,670,449 | A | 6/1972 | Lemkin et al. | |
| 3,791,090 | A | 2/1974 | Kniefel | |
| 3,811,219 | A | 5/1974 | Fischer | |
| 3,827,177 | A | 8/1974 | Wengel | |
| 3,987,579 | A | 10/1976 | Palenik, III | |
| 4,007,555 | A | 2/1977 | Sasaoka | |
| 4,035,977 | A | 7/1977 | Fischer | |
| 4,050,184 | A | 9/1977 | Chiari | |
| 4,109,409 | A | 8/1978 | Fischer | |
| 4,171,591 | A | 10/1979 | Fischer | |
| 4,202,131 | A | 5/1980 | Poleri | |
| 4,214,403 | A | 7/1980 | Knudsen | |
| 4,309,852 | A | 1/1982 | Stolpin | |
| 4,355,781 | A | 10/1982 | Stolpin | |
| 4,423,464 | A | 12/1983 | Ten-Ching et al. | |
| 4,673,057 | A | 6/1987 | Glassco | |
| 4,701,131 | A | 10/1987 | Hildebrandt et al. | |
| 4,703,594 | A | 11/1987 | Reber | |
| 4,744,780 | A | 5/1988 | Volpe | |
| 4,758,196 | A | 7/1988 | Wang | |

(List continued on next page.)

FOREIGN PATENT DOCUMENTS

| | | |
|---|---|---|
| CH | 208999 | 11/1966 |
| GB | 941847 | 11/1963 |
| GB | 223238 | 12/1990 |
| WO | WO9420186 | 9/1994 |

*Primary Examiner*—Jacob K. Ackun
(74) *Attorney, Agent, or Firm*—Birch, Stewart, Kolasch & Birch, LLP

(57) ABSTRACT

Spaced-apart blocks are interconnected by planar sheets. Thus, different configurations for the toy building blocks can be obtained. A simple geometric shape can be provided which is capable of interlocking in different directions and is capable of a choice of framing pieces. Retrofit interconnecting elements can be provided which facilitate the addition of planar members to the construction.

15 Claims, 4 Drawing Sheets

U.S. PATENT DOCUMENTS

| | | | | |
|---|---|---|---|---|
| 4,764,143 | A | | 8/1988 | Gat et al. |
| 4,833,856 | A | | 5/1989 | Zwagerman |
| 5,100,359 | A | | 3/1992 | Gorio |
| 5,137,486 | A | | 8/1992 | Glickman |
| 5,199,919 | A | | 4/1993 | Glickman |
| 5,350,331 | A | | 9/1994 | Glickman |
| 5,527,201 | A | | 6/1996 | Maddock |
| 5,575,701 | A | | 11/1996 | Hantman |
| 5,707,268 | A | | 1/1998 | Outman |
| 5,775,046 | A | | 7/1998 | Fanger et al. |
| 5,975,977 | A | * | 11/1999 | Choi ..... 446/105 |

* cited by examiner

PANELLING AND SUPPORTS FOR INTERCONNECTED TOY BLOCKS

RELATED INVENTIONS

This application claims priority on provisional Application No. 60/170,780 filed on Dec. 15, 1999 and this application is a continuation-in-part of application Ser. No. 09/149,477 filed Sep. 8, 1998 now U.S. Pat. No. 6,059,631 which is a continuation-in-part of PCT application Ser. No. PCT/CA97/00138 filed on Feb. 28, 1997, which designated the United States and on which priority is claimed under 35 U.S.C. 120, the entire contents of all application are hereby incorporated by reference.

BACKGROUND OF THE INVENTION

1. Field of the Invention

This invention relates to improvements in toy building blocks whereby spaced-apart blocks may be interconnected by planar sheets.

2. Description of the Prior Art

Toy building blocks of many different configurations are, of course, very well known and popular and have always been one of the most popular toys in a wide variety of cultures. The building blocks take many different forms and some of these forms have become extremely well known in association with their respective trademarks. The blocks employ various interconnection means to permit them to be snapped, or otherwise held, together in a fixed relationship in order to build structures.

Building toys also exist which employed hinged connections between the parts and a number of building toys employ connector pieces which permit structures to be assembled from larger framing pieces.

Interconnected toy building blocks which also included interconnected planar members are known in the art. For example, U.S. Pat. No. 1,281,856, patented Oct. 15, 1918, by G. E. Shaw, U.S. Pat. No. 1,883,214, patented Oct. 18, 1918, by E. B. Wilson et al, U.S. Pat. No. 2,633,662, patented Apr. 7, 1953, by W. O. Nelson, and U.S. Pat. No. 3,827,177, patented Aug. 6, 1974, by G. Wengel, all taught toy construction sets in which the elements thereof were held together by cooperation between planar members and grooves in cube-like, cylindrical or disc-like connectors.

U.S. Pat. No. 3,657,838, patented Apr. 25, 1972 by R. Hanning et al taught toy blocks which included corner pieces in the form of hollow rectangle parallelepiped blocks which had parallel-disposed, dovetail-shaped grooves, while other such toy blocks had parallel-disposed, dovetail-shaped ribs, while still others had both parallel disposed dovetail-shaped grooves and parallel disposed dovetail-shaped ribs. In addition, construction rods were provided which had dovetail-shaped projections at each end. Connection members were also provided which had such a cross-section that they were at least partly insertable into hollow spaces of the corner pieces. The construction rods were lockable by means of holding members.

U.S. Pat. No. 4,764,143, patented Aug. 16, 1988, by A. Gat et al, disclosed various interlocking toy blocks whose interlocking was primarily by means of dovetail grooves and dovetail ribs, but which also disclosed planar portions to provide triangular or rectangular enclosures.

A particularly relevant patent is U.S. Pat. No. 5,527,201, patented Jun. 18, 1996, by the present inventor, Paul T. Maddock. That patent provided a toy construction kit with interconnecting holding means, and included a plurality of building pieces of various configurations, including building pieces each having six faces, each one of the six faces having interconnection means which was configured for direct connection to complementary interconnection means on other building pieces. The interconnection means in at least one of the faces included an aperture defined therein which was particularly sized and shaped to receive a connector member in the kit which was either a planar, essentially rectangular cross-section elongate element or a planar, essentially rectangular cross-section tongue integral with and extending from another building piece. The other faces each had other interconnection means, including at least two of the following: A pin which was parallel to a face of the piece which was particularly sized to engage a corresponding sleeve on another piece, for hinged connection such that one piece may rotate with respect to another piece; or a sleeve parallel to a face of the piece, which was particularly sized to engage a corresponding pin on another piece, for hinged connection such that one piece may rotate with respect to another piece; or a male dovetail on a face of the piece which was particularly sized to engage a corresponding female dovetail on another piece such that one piece slidably engages with another piece; or a female dovetail on a face of the piece, which was particularly sized to engage a corresponding male dovetail on another piece such that one piece slidably engaged with another piece; or a tongue of rectangular cross-section projecting from a face of the piece which was particularly sized to engage one of the apertures. The patent also provided a row of interconnected blocks which were further interconnected by stick-like columns.

U.S. Pat. No. 5,775,046 patented Jul. 7, 1998 by D. J. Fanger et al provided modular construction units as L-shaped or U-shaped or open-ended rectangular parallelepiped boxes. Each of the members was provided with an array of cooperating dovetails and dovetail-shaped keyways. These elements were closely spaced so that a pair of such members could be meshed together and be locked against motion in two directions. Specially-located engaging elements along the length of the construction units or the sides of the units made therefrom allowed mated construction members to be translated relative to each other as desired, even if one construction member was mated therewith, and bridged across two facing construction members, thus exhibiting translational symmetry. They also facilitate the rotation in place of any units made from a plurality of construction members, thus exhibiting rotational symmetry. The patent also provided planar members which could be linked together by connectors to form triangular or pentagonal enclosures.

U.S. Pat. No. 5,707,268, patented Jan. 13, 1998, by K. S. Outman provided toy construction sets in which the individual units were held together through means cooperating with holes in the toy blocks. The individual units consisted of a triangular plate, an elongated slot adjacent to an edge of the plate, and an elongated coupling sleeve.

The above-identified copending application Ser. No. 09/149,477 also disclosed toy building pieces which may be advantageously used in conjunction with a variety of differently-shaped framing pieces or connectors for building of structures, e.g., polyhedral figures, geodesic domes or many other structures. One or more faces of the building pieces had interlocking means in the form of dovetail tongues and/or dovetail grooves, and had an aperture in the surface thereof to receive a thin rectangular shape, or a cylindrical-shaped end of a framing piece of various cross-section or connectors, which were I-shaped in cross-section.

Other faces of the modular element incorporated interconnection means, which included for example: especially configured angular connection pieces which can be used in conjunction with other pieces to construct polyhedral figures; other pieces which are designed for hinged connection; a dovetail tongue on one part which is adapted to engage a dovetail groove on another part; or a tongue projecting from a face to engage one of the apertures. The adapter pieces were provided to change the connection means of a piece.

Such copending application Ser. No. 09/149,477 also provided axial connecting members in the form of rectangularly-shaped panels having edges which were adapted to be inserted into receptive recesses which are provided in, or by, a plurality of interconnected blocks. It further included axial connecting members in the form of thin-walled panels, which were either planar or which included curved surfaces. It further included axial connecting members in the form of thin-walled panels having perforated openings therethrough, the thin-walled panels being either planar or including curved surfaces. It also included axial connecting members in the form of thin-walled panels having perforated openings therethrough, the thin-walled panels being either planar or including curved surfaces, in combination with a plurality of connecting members which were provided with a cylindrical projection for engagement through the perforated openings and into the central hollow cylindrical members of the modular elements.

In more specific terms, such copending application Ser. No. 09/149,477 provided a framework of primary blocks supplied with panels which can be attached to the interconnected blocks for making walls of toy buildings. The panels can be connected to the blocks using a circular button connector with a shoulder provided thereon. This will pass through the perforation in the panel and can be held in the recess of the primary blocks. The panels can also be supported by dovetail grooves of the primary blocks by using support pieces. The panels maybe provided with printed matter for further enhancement. The panels can also be triangular or any other suitable shape if preferred.

Thus, as noted above, many prior art building block toys have many obvious attractions and should not be criticised. However, there is always a demand for new building block toys which may offer different possibilities from those of the prior art. It is believed that the construction sets available on the market can be made still more versatile. For example, a wall may be constructed similar to bricks with the most popular blocks with interconnection on two faces. Although there are special pieces to expand in other directions, the blocks were not provided with an alternative for making a framed structure. On the other hand, while some construction sets provided good framing features, the individual pieces could not interlock to form a solid wall. It is also believed that most toy kits are limited since they could not be used to construct the many attractive polyhedral and spherical shapes shown in some geometry books.

SUMMARY OF THE INVENTION (a) Aims of the Invention

It is an object of the present invention to provide a retrofit interconnecting element to provide a novel construction toy which will offer an attractive alternative to various prior art building blocks.

It is also an object of the present invention to provide improvements in interconnectable toy building blocks having a basically simple geometric shape which is capable of interlocking in different directions and capable of a choice of framing pieces, in the nature of a retrofit interconnecting element which facilitates the addition of planar members to the construction.

(b) Statement of Invention

The present invention provides an improvement in a toy building block system in which a block is interconnectable with an interconnectable block, the improvement comprising an interconnecting profile which is connectable to at least one of the interconnectable blocks and is provided with copending means to engage and secure a planar panel.

The profile is preferably formed from an extrudable synthetic plastic material, e.g., polyethylene or polyvinylchloride. The copending means is generally in the form of a slot, e.g., a "T"-slot, an "H"-slot or an "X"-slot.

The panels may cooperate with the blocks to be parallel to at least one face thereof or my be such as to be angularly disposed thereof.

The blocks may be an interconnectable block, e.g., VECTA BLOCKS™ as described in U.S. Pat. No. 5,527,201 or in the above-identified pending application Ser. No. 09/149,477; or the LEGO™ blocks described in U.S. Pat. No. 3,005,282 or in U.S. Pat. No. 4,214,403; or the TYCO™ blocks described in U.S. Pat. No. 4,744,780.

Further scope of applicability of the present invention will become apparent from the detailed description given hereinafter. However, it so be understood that the detailed description and specific examples, while indicating preferred bodies of the invention, are given by way of illustration only, since various changes and modifications within the spirit and scope of the invention will become apparent to those skilled in the art from this detailed description.

BRIEF DESCRIPTION OF THE DRAWINGS

The invention being thus described, it will be obvious that the same may be varied in many ways. Such variations are not to be regarded as a departure from the spirit and scope of the invent, and all such modifications as would be obvious of the to one skilled in the art are intended to be included within the scope of the following claims.

Figure 2:
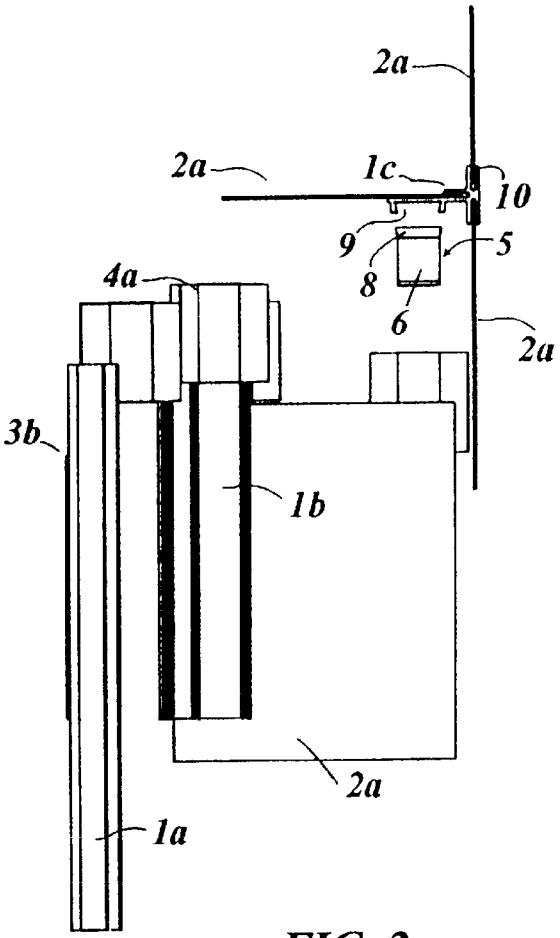
FIG. 2 is a side elevational view of the assembly of pieces shown in FIG. 1.
Figure 1:
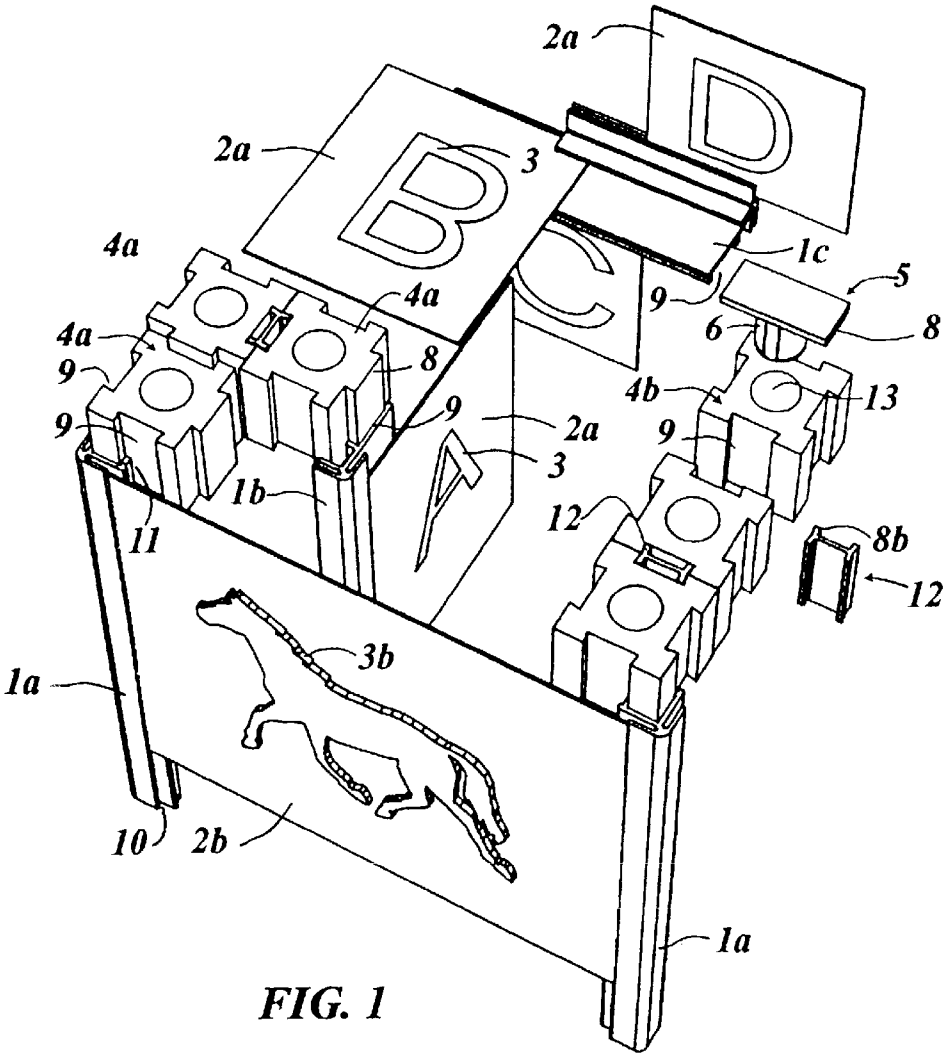
FIG. 1 is a perspective view of interconnecting blocks with dovetail interconnections, with several examples of different elongated panel supports and five panels.

DESCRIPTION OF PREFERRED EMBODIMENTS (a) Description of FIG. 1 and FIG. 2

Referring now to the drawings, FIG. 1 shows details of a number of toy blocks 4*a* which are connected to similar blocks using male dovetail tongue connectors 8 which are sized to fit female dovetail grooves 9. Also shown are blocks 4*b*, which have four female grooves 9 and which are connected together using a double male tongue 8*b* adapter piece 12. FIG. 1 also shows five thin-walled panels 2*a*, which are illustrated with text or artwork 3 and panels 2*b* having embossed artwork 3*b*, these panels being supported at different orientations by means of elongated slotted 10 support members 1*a*, 1*b* and 1*c*. The elongated support member 1*a* is designed to slide with a snug fit around the corner of blocks 4*a* or 4*b* engaging the side surface 11 of both adjacent female grooves 9. This member is provided with two adjacent elongated panel slots 10 that can engage the edge of two panels 2*a* or 2*b* and thus forming an outside corner support. The elongated support members 1*b* and 1*c* are designed to form corner supports for two or three panels 2*a* or 2*b*. This differs from the corner support 1*a* in that a female groove 9 is provided in its design to form a slide fit with the male tongue 8 of the block 4*a* or the male tongues 8*b* provided on the adapter piece 12 and male tongue on the adapter ADAPTEC™ piece 5. The adapter piece 5 contains a cylindrical tongue 6 which can be inserted into a cylindrical recess 13 which is provided in the toy blocks 4*a* and 4*b*. This recess forms a rotatable sliding fit for the tongue.

FIG. 2 is a side elevational view showing the assembly of pieces shown in FIG. 1. It shows more clearly the adapter piece 5 with male dovetail 8 to cylindrical tongue 6. This also shows more clearly the end view of the female groove 9 on the support piece 1*c*, also showing three slots 10 in the form of a "tee" and shows three panels 2*a* being supported in a "tee" assembly.

Figure 3:
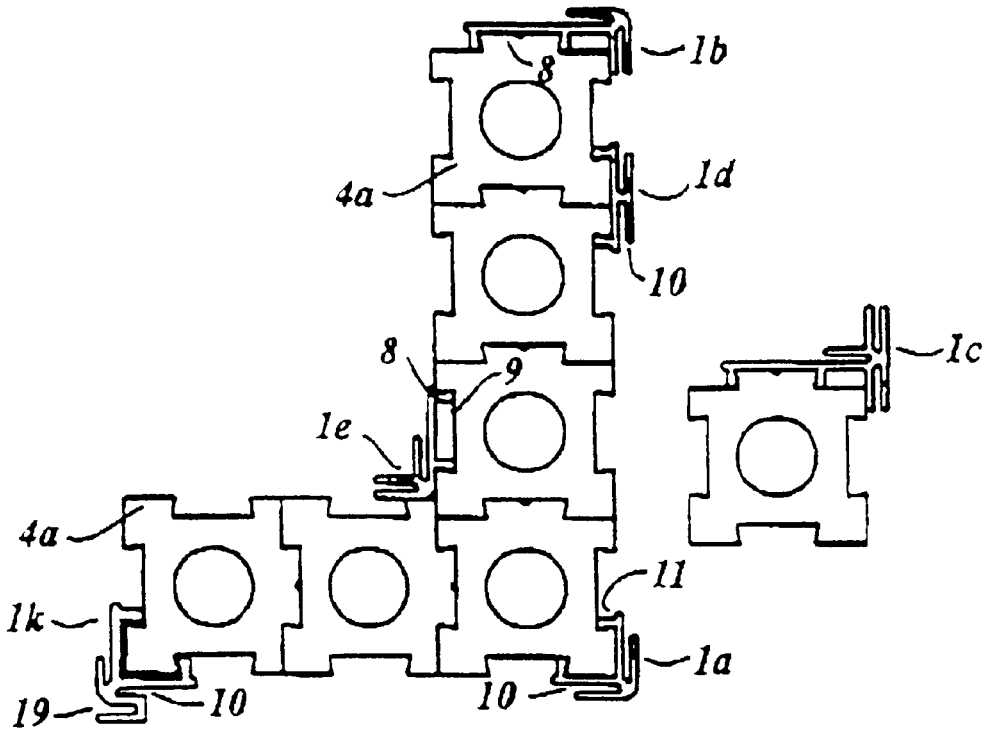
FIG. 3 is an illustration showing the end-view of blocks with dovetail interconnecting means connected to different examples of panel support pieces.

(b) Description of FIG. 3

FIG. 3 shows five different support pieces 1*a*, 1*b*, 1*c*, 1*d*and 1*e*. The corner support 1*a* and 1*b* as earlier described. Also shown is the "tee" support piece 1*c*, and support piece 1*d*. This is used to join two panels together on the same plane using the panel slots 10. The inside comer support 1*e* provides a male tongue portion 8 to engage in the female groove 9 of the toy block 4*a*.

Figure 4:
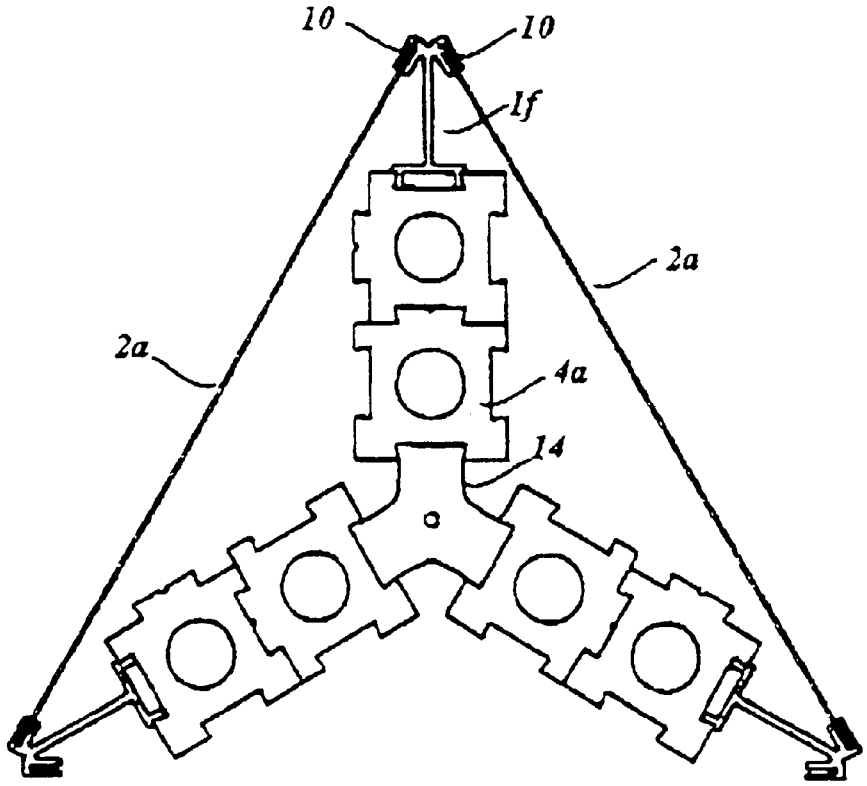
FIG. 4 is an illustration showing the end-view of blocks with dovetail interconnecting means connected to pieces suitable for supporting two panels at an acute angle.

(c) Description of FIG. 4

FIG. 4 shows another variation of the support piece if this one provides two slots 10 disposed to each other at an acute angle. These two slots 10 are shown supporting two panels 2*a* at an angle of 60 degrees to each other, although other angles can be used without a major design change.

(d) Description of FIGS. 5 to 9

Figures 5, 6, 7, 8, 9:
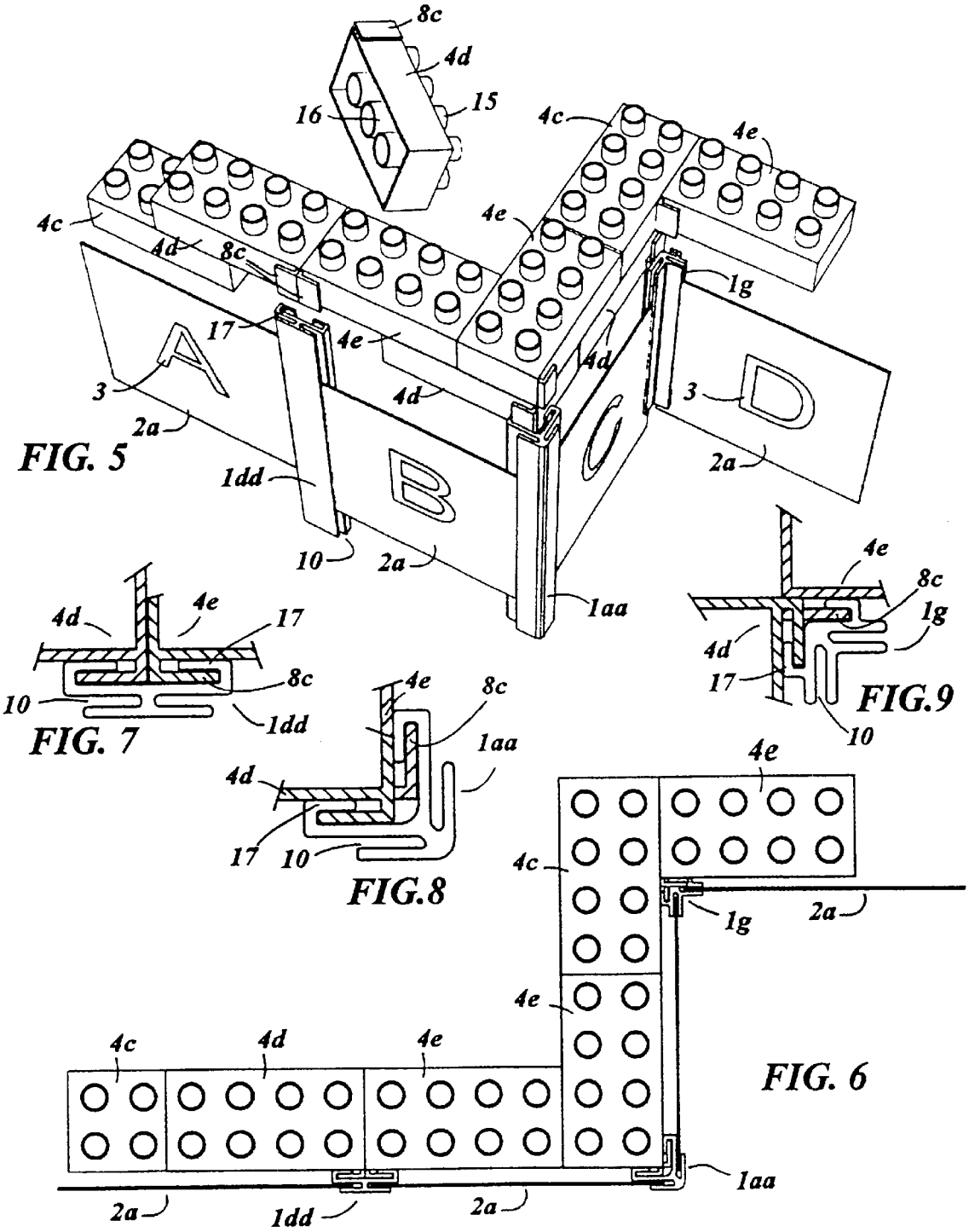
FIG. 5 is a perspective view of an assembly using another type of interconnecting toy block, with some panels supported by elongated pieces very similar to ones shown in FIG. 1.
FIG. 6 is a top plan view of the assembly of pieces shown in FIG. 5.
FIG. 7 is a closeup showing the end view of an elongated panel support shown in FIG. 5.
FIG. 8 is a closeup showing the end view of another elongated panel support in FIG. 5.
FIG. 9 is a closeup showing the end view of another elongated panel support in FIG. 5.

FIG.5 shows support pieces 1*dd*, 1*aa* and 1*g*. A different style of interconnected block 4*c* is shown. This style is described in expired U.S. Pat. No. 3,005,282 having studs or cylindrical projections 15 and having openings 16 for receiving the turrets on the other end permitting the turrets of one block to be inserted into the openings of another block for interconnection. These blocks are well known and are manufactured and sold commercially by a variety of manufacturers. As shown some of the blocks 4*d* and 4*e* have been redesigned, in the shape of a corner elbow 8*c* which is added to the edge of one of the faces of the toy block 4*d*. Another block 4*e* is designed to have the elbow on the opposite end so that both blocks can be placed end to end, thus positioning the two elbows 8*c* back-to-back. The panel support piece 1*dd* is very similar to the support piece id shown in FIG. 3. It can support two panels 2*a* end-to-end in the same plane.

FIG. 6 shows a top elevational view of FIG. 5. The panels 2*a* can be seen supported in front of the blocks 4*c* 4*d* and 4*e* by the three panel support pieces 1*dd*, 1*aa* and 1*g*.

FIG. 7 is an end closeup view of the panel support piece 1*dd*. It shows the panel slots 10 in an "H"-shaped configuration. Two corners of the toy blocks 4*d* and 4*e* are shown with the elbow tabs 8*c* back-to-back with the panel support piece 1*dd* providing two lips 17 that locate with a sliding fit along the recess behind 8*c*.

FIG. 8 is an end closeup view of the panel support piece 1*aa*. It shows the panel slots 10 in an "L"-shaped configuration and forms an outside corner support for two panels. Two lips 17 are provided which can be held by two blocks stacked one on top of the other so that the elbow tabs 8*c* can support the two lips 17.

FIG. 9 shows the panel support piece 1*g* also shows slots in a L-shaped configuration but this time the panel slots 10 are used to form an inside corner support for the panels 2*a* also shown in FIG. 5. This panel support piece is also supported by elbow tags 8*c* that are provided on two sides by stacking two blocks on top of each other.

Figure 10:
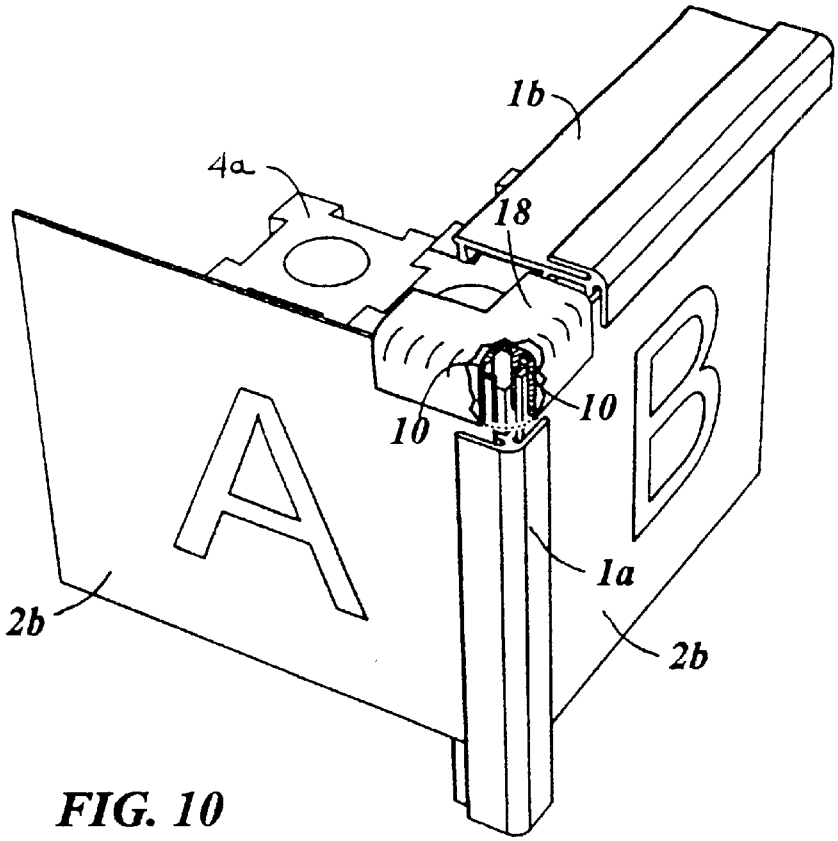
FIG. 10 is a perspective view of an assembly of blocks supporting two panels with a molded corner piece covering the three edges of the panel.

(e) Description of FIG. 10

FIG. 10 shows two panels 2*b* which are supported at right angles by three interconnected blocks 4 and by two panel support pieces 1*a*, which are shown running in a vertical direction. They are supported by a slide fit at the corner of a block 4*a* and by support piece 1*b* which is supported above the blocks by an adapter piece similar to 5 (not visible but as shown in FIG. 1). At the top vertex of the adjoining ends of the adjacent panels 2*b* is shown a molded corner 18. Slots 10 are provided on the molded corner piece 18 to receive a small part of the two adjacent panels 2*b*. This supports the molded corner piece 18 to receive a small part of the two adjacent panels 2*b*. This supports the molded corner 18 at a correct orientation, giving the framed corner a cosmetic finish.

(f) Description of FIGS. 11 to 14

Figure 11:
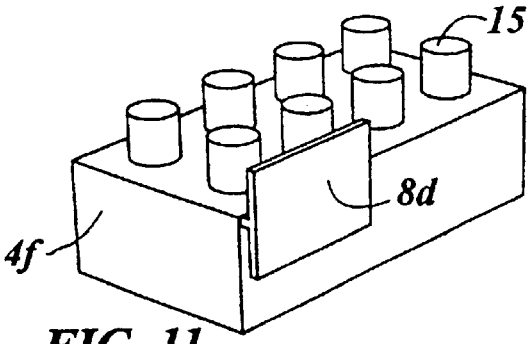
FIG. 11 is a perspective view of a modified interconnecting block with a horizontal "tee" tab.

FIG. 11 shows toy block 4*f* which is similar to 4*c*, but which has a modified side face that provides a "tee" plate 8*d* running parallel to the projecting cylinders 15.

Figure 12:
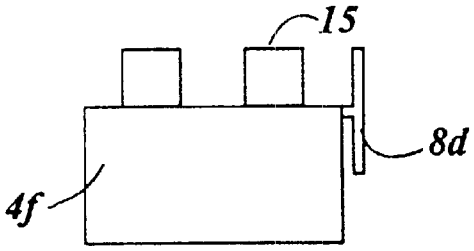
FIG. 12 is a side view of the toy block shown in FIG. 11.

FIG. 12 shows a side view of FIG. 11.

Figure 13:
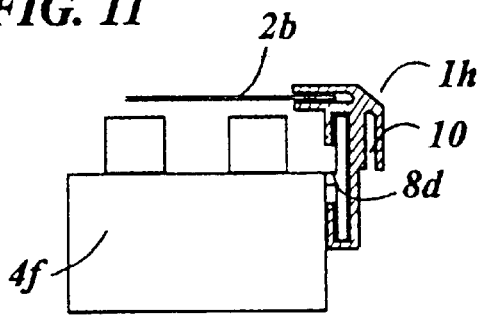
FIG. 13 is another side of the toy block shown in FIG. 11 with right angle panel supported pieces attached.

FIG. 13 shows a side view of the toy block 4*f* in FIG. 11. It also shows the end view of a right-angled, two-panel support piece 1*h* with the panel 2*b* being supported by one of the slots 10 in the horizontal plane.

Figure 14:
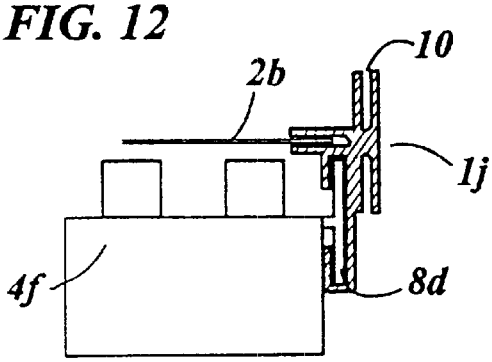
FIG. 14 is another side view of the toy block shown in FIG. 11 with a "tee" panel support piece attached.

FIG. 14 shows a side view of the toy block 4*f* in FIG. 11. It also shows the end view of a three-panel support piece 1*j* with three slots 10 in a "tee" configuration with the panel 2*b* being supported by one of the slots 10 in the horizontal plane.

The original above-identified copending application Ser. No. 09/149,477 shows panels which were supported by using holes in the panels and by manufacturing buttons to hold the panels to the blocks. It was realized by using this method, the artist needed the assistance of a designer when coming up with a new building. The artist had a problem with cutting a panel because the hole locations had to be exact. In the development of this invention, it was realized that by having a simple rectangularly-shaped panel, it was much easier for the artist to cut to different sizes without worrying about the hole centers.

Therefore the present inventor came up with the idea of supporting the panels with elongated support pieces with panel slots.

The comer stripping was found to make a much nicer finish, similar to wood molding around household doors. These type of panel supports can be extruded. The die is much cheaper to produce than a mold. The extruded pieces have to be cut to length and sharp corners must be eliminated. PVC or polyethylene may be used for extruding. Polypropylene can be used with injection molding. An advantage of the elongated panel supports is that they cut down on the number of blocks needed to construct a building as they themselves help to strengthen the construction and rescue the overall cost of the toy. The panel grooves also make it possible to support thin-walled panels which can be printed or embossed and cut to size much cheaper in volume than using a material of heavy wall construction, although plywood can also be used.

CONCLUSION

From the foregoing description, one skilled in the art can easily ascertain the essential characteristics of this invention, and without departing from the spirit and scope thereof, can make various changes and modifications of the invention to adapt it to various usages and conditions. Consequently, such changes and modifications are properly, equitably, and "intended" to be, within the full range of equivalence of the following claims.

I claim:

1. A toy building block system comprising:

a plurality of interconnectable toy building blocks;

a relatively-thin planar panel in sheet form interconnecting at least some of said toy building blocks;

an interconnecting profile including:

(1) an inner elongated planar slot which is configured to be removably engageable with a selected surface of one said toy building block, and (2) an outer elongated planar slot which is spaced-apart from said inner elongated planar slot, wherein said outer elongated slot is configured removably to engage said relatively-thin planar panel in sheet form which is disposed in said outer elongated slot.

2. The toy building block system as claimed in claim 1, wherein said outer elongated planar slot is parallel to said inner elongated planar slot.

3. The toy building block system as claimed in claim 1, wherein said toy building block is of cubic configuration in which a first pair of opposed side faces each have a male dovetail connector projecting therefrom, and in which a second opposed pair of side faces each have a female dovetail groove disposed therein, and wherein said inner elongated slot is configured to be removably engageable with a corner of said cubic block at the intersection of a side face having a male dovetail projecting therefrom and a side face having a female dovetail groove disposed therein.

4. The toy building block system as claimed in claim 1, wherein said toy building block is of cubic configuration in which a first pair of opposed side faces each have a male dovetail connector projecting therefrom, and in which a second opposed pair of side faces each have a female dovetail groove disposed therein, and wherein said inner elongated slot is configured to be removably engageable with one of said male dovetail connectors.

5. The toy building block system as claimed in claim 1, wherein said toy building block is of cubic configuration in which a first pair of opposed side faces each have a male dovetail connector projecting therefrom, and in which a second opposed pair of side faces each have a female dovetail groove disposed therein, and wherein said inner elongated slot is configured to be removably engageable with a male dovetail connector which is formed by abutment of two adjacent said toy building blocks.

6. The toy building block system as claimed in claim 3, wherein said connector includes a pair of mutually-transverse outer elongated slots.

7. The toy building block system as claimed in claim 4, wherein said connector includes a pair of mutually-transverse outer elongated slots.

8. The toy building block system as claimed in claim 5, wherein said connector includes a pair of mutually-transverse outer elongated slots.

9. The toy building block system as claimed in claim 3, wherein said connector includes a pair of non-connected aligned slots.

10. The toy building block system as claimed in claim 4, wherein said connector includes a pair of non-connected aligned slots.

11. The toy building block system as claimed in claim 5, wherein said connector includes a pair of non-connected aligned slots.

12. The toy building block system as claim 1, wherein said toy building block is of cubic configuration in which a pair of opposed side faces each have a male dovetail connector projecting therefrom, and in which other opposed pair of opposed side faces each have a female dovetail groove disposed therein, wherein said inner elongated slot is configured to be removably engageable with a female dovetail grove disposed in a side face thereof, and wherein said connector includes a pair of angularly-oriented outer elongated slots, said pair of angularly-oriented slots being connected to said inner elongated slot by way of a planar interconnecting piece.

13. The toy building block system as claimed in claim 1, wherein said toy building block is of rectangular parallelepiped configuration having a plurality of cylindrical projections on its upper face and a complementary plurality of cylindrical wells in the opposed lower face, and wherein said interconnecting profile includes a separate secondary profile which is configured to be removable connected to said toy building block, said secondary profile including a flange which is configured to be removably connected to said inner elongated slot.

14. The toy building block system as claimed in claim 13, wherein said secondary connecting profile has a T-shaped cross-section.

15. The toy building block system as claimed in claim 13, wherein said secondary connecting profile has an L-shaped cross-section.

* * * * *